US007764899B2

(12) United States Patent
Kurosu

(10) Patent No.: US 7,764,899 B2
(45) Date of Patent: Jul. 27, 2010

(54) IMAGE FORMING APPARATUS INCLUDING A RECORDING MEDIUM EDGE CLEANER

(75) Inventor: Shigetaka Kurosu, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 278 days.

(21) Appl. No.: 11/714,570

(22) Filed: Mar. 6, 2007

(65) Prior Publication Data

US 2007/0280723 A1 Dec. 6, 2007

(30) Foreign Application Priority Data

May 30, 2006 (JP) ..... 2006-149482

(51) Int. Cl.
*G03G 21/00* (2006.01)
*G03G 15/00* (2006.01)

(52) U.S. Cl. ..... 399/99; 399/352; 399/357; 399/390

(58) Field of Classification Search ..... 399/99, 399/343, 352, 357, 390
See application file for complete search history.

(56) References Cited

U.S. PATENT DOCUMENTS 6,150,066 A * 11/2000 Kurotori et al. ..... 430/97
2003/0113144 A1* 6/2003 Kanazawa et al. ..... 399/343
2004/0076446 A1* 4/2004 Ziegelmuller et al. ..... 399/99
2006/0104686 A1* 5/2006 Yasui ..... 399/388

FOREIGN PATENT DOCUMENTS

| | | |
|---|---|---|
| JP | 7-239617 | 9/1995 |
| JP | 7-271256 | 10/1995 |
| JP | 2002-244462 | 8/2002 |

OTHER PUBLICATIONS

Machine translations of Japanese Patent Pub. No. 07-239617 to Yamauchi, Japanese Patent Pub. No. 2002-244462 to Suzuki et al., and Patent Pub. No. 07-271256 to Ogawa et al.*

* cited by examiner

*Primary Examiner*—David M Gray
*Assistant Examiner*—Joseph S Wong
(74) *Attorney, Agent, or Firm*—Cantor Colburn LLP

(57) ABSTRACT

An image forming apparatus including an image forming section that forms an image with a recording material on a recording medium to an edge thereof, and a cleaning section that cleans off the recording material adhering to an edge surface of the recording medium after the image forming section forms the image thereon.

10 Claims, 6 Drawing Sheets

IMAGE FORMING APPARATUS INCLUDING A RECORDING MEDIUM EDGE CLEANER

This application is based on Japanese Patent Application No. 2006-149482 filed on May 30, 2006 in Japanese Patent Office, the entire content of which is hereby incorporated by reference.

FIELD OF THE INVENTION

The present invention relates to an image forming apparatus, such as an electro-photographic copier, printer or facsimile, and particularly relates to an image forming apparatus having a cleaning device that cleans the edge surfaces of sheets as recording mediums.

BACKGROUND OF THE INVENTION

When an image is output to peripheral edge portions of a recording medium (al so referred to as a sheet), recording material (such as toner or ink) spreads out of the image area to peripheral portions of the sheet, as shown in FIG. 4, which causes a problem of contaminating the hands of a user and other print sheets in taking out a stack of sheets or handling a file.

FIG. 4 shows an example of contamination of edge surfaces of sheets.

In order to avoid such toner contamination, there are offered methods (for example, refer to Patent Document 1: Japanese Patent Publication TOKKAI No. H07-239617) which bias, in the same polarity as transfer, a transfer entrance guide plate for guiding a sheet to the transfer area to keep toner away and control the timing of biasing, methods (for example, refer to Patent Document 2: Japanese Patent Publication TOKKAI No. H07-271256 and Patent Document 3: Japanese Patent Publication TOKKAI No. 2002-244462) which remove toner adhered to the back side surface of a sheet, and methods (for example, refer to Patent Document 3: Japanese Patent Publication TOKKAI No. 2002-244462) which arrange a suction fan between the transfer area and fixing to absorb spattering or floating toner.

However, just by the method which is a technology disclosed in above Patent Document 1 to prevent toner contamination of edge surfaces of a sheet by the timing of biasing a transfer entrance guide plate, it is difficult to remove toner having been adhered.

The technology disclosed in Patent Document 2 only removes toner contaminating the back side surface of a sheet, but does not disclose about contamination of edge surfaces. The technology disclosed in Patent Document 3 is effective for collecting toner spattering from a sheet, but is not capable of removing toner adhered to a sheet, and may degrade an unfixed image with a large air flow rate.

An object of the present invention is to provide an image forming apparatus having a cleaning device for preventing contamination by excess toner (or ink) adhered to edge surfaces of a sheet even when outputting an image to edge portions.

SUMMARY OF THE INVENTION

To solve an object, as described above, in an aspect of the invention, there is provided a structure described below.

An image forming apparatus, comprising:

an image forming section being enable to form an image with a recording material on a recording medium to an edge thereof; and a cleaning section that cleans off the recording material adhering to an edge surface of the recording medium after the image forming section forms the image thereon.

DETAILED DESCRIPTION OF THE PREFERRED EMBODIMENTS

Image recording apparatuses in accordance with the invention will be described below, according to preferred embodiments.

Figure 1:
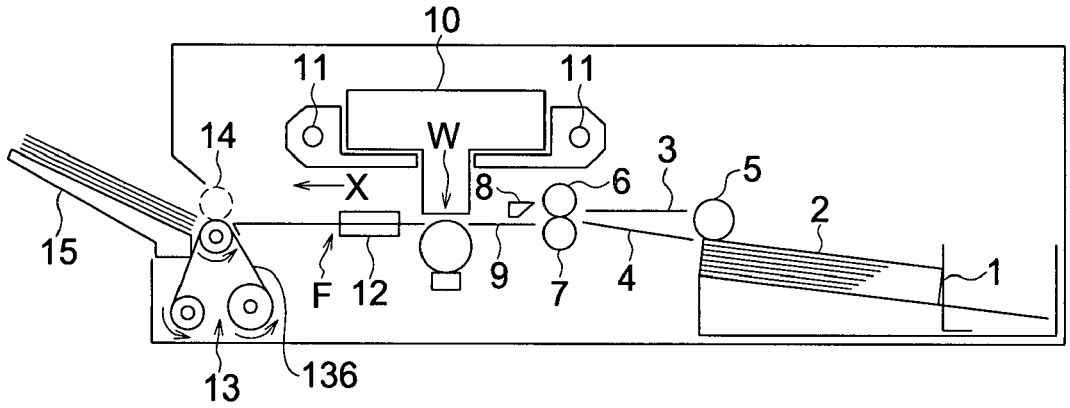
FIG. 1 is a schematic diagram of an inkjet printer in a first embodiment of the invention.

FIG. 1 is a schematic diagram of an inkjet printer in a first embodiment of the invention.

In FIG. 1, a sheet 2 conveyed from a sheet feeding cassette 1 is fed out with a pickup roller 5; guided by upper and lower guide plates 3 and 4; nipped and conveyed by upper and lower conveying rollers 6 and 7. The conveyed sheet is synchronized with printing by a registration unit, not shown, in the process passing upper and lower guide plates 8 and 9 during conveyance; and is subjected to printing by a recording head section W, which slides in the main scanning direction along guide rails 11, up to the edge portion of the sheet in the main scanning direction. Then excess ink adhered to the both edge surfaces in the main scanning direction of the sheet is adsorbed by cleaning members 12 being cleaning devices disposed on the both sides in the conveying process at the a conveying section F. The sheet is conveyed further and the leading edge surface of the sheet reaches a cleaning member 13 when excess ink at the leading edge surface is adsorbed. Then, the sheet is ejected onto a slanted sheet ejection tray 15, and thereafter ink at the trailing edge surface is adsorbed by the cleaning member 13.

The cleaning members 12 and 13 will be described in detail below.

Figure 2:
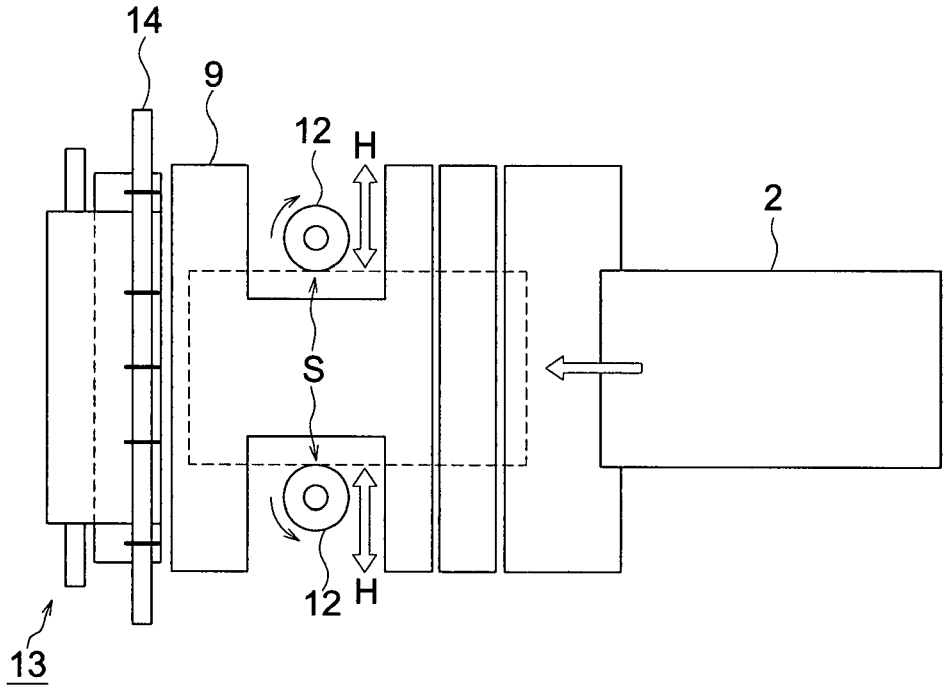
FIG. 2 is a top view of a conveying path for a sheet in FIG. 1.

FIG. 2 is a top view of the conveying path for the sheet in FIG. 1.

Figure 3:
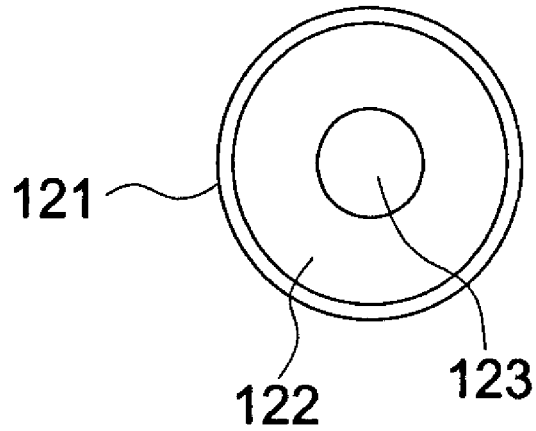
FIGS. 3*a* and 3*b* are diagrams illustrating the structures of cleaning members in FIG. 1.
Figure 3:
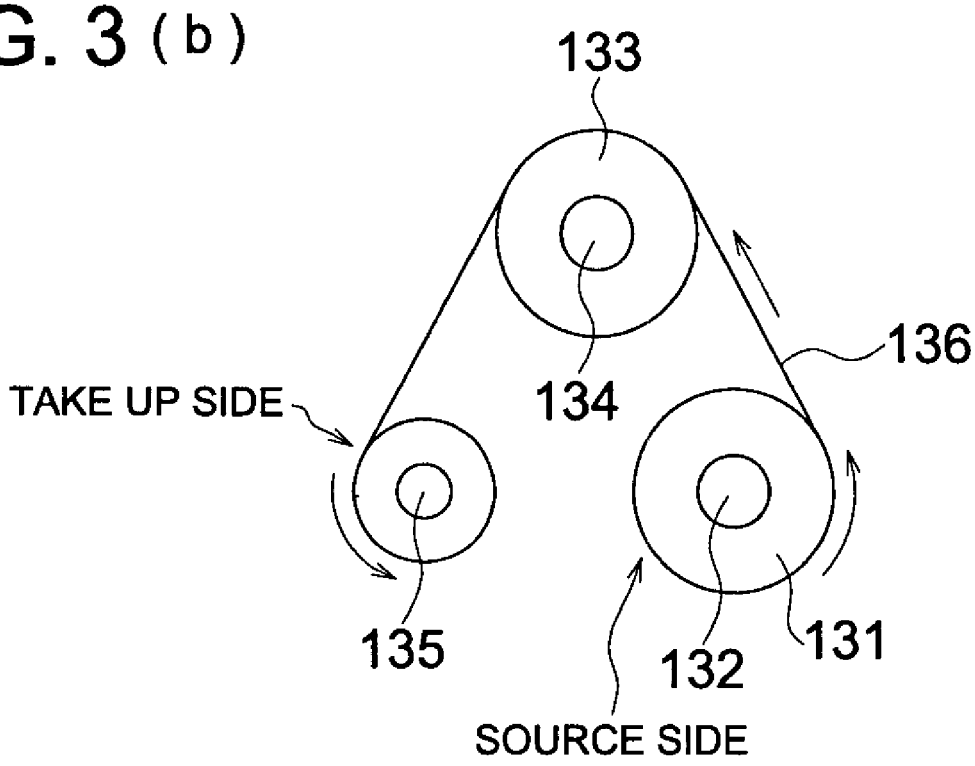
Figure 4:
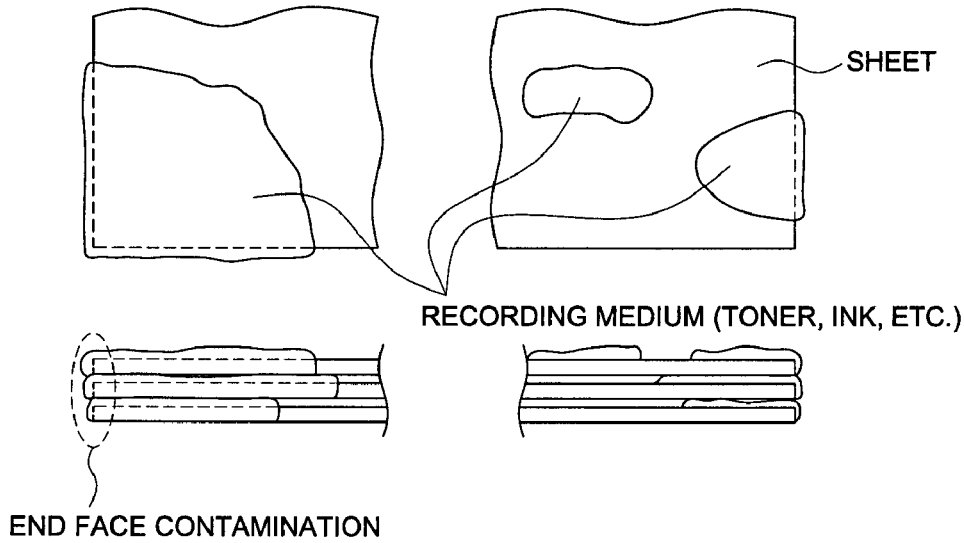
FIG. 4 is a diagram showing contamination of edge surfaces of a sheet.

FIGS. 3*a* and 3*b* are diagrams illustrating the structures of the cleaning members in FIG. 1.

FIG. 3*a* shows a cross section of the cleaning member 12, which is constructed with a sponge roller 122, core metal 123 being the rotation shaft of the sponge roller 122, and a non-woven fabric 121 wound around the sponge roller 122, and the like. The cleaning members 12 are mounted on sliding members, not shown, slidable in arrow direction H, and the positions of the slide rollers 122 are controlled by a control unit so that both side edge surfaces of a sheet contact the sponge rollers 122, corresponding to the width size of the sheet. The core metals 123 are driven by a driving section, not shown, and thus the sponge rollers 122 rotate in the same direction as the conveyance of the sheet at a contact section S.

At the contact section S in the process where a sheet, which has been subjected to printing by the printing section W of a recording head 10, passes the conveying section F, excess ink at the both side edge surfaces of the sheet is adsorbed, and the leading edge of the sheet reaches the cleaning member 13.

FIG. 3*b* shows the cross-section of the cleaning member 13, which is constructed with a nonwoven fabric 131 wound around a rotation shaft 132, sponge guide roller 133, take up shaft 135, and the like. A web belt 136 is tension-supported by the nonwoven web roll 131, which is the source side edge, and the take up shaft 135 via the guide roller 133. The take up shaft 135 is driven by a driving section, not shown, and rotates at a predetermined rotation speed to take up the belt.

When the leading edge surface of a printed sheet has reached the cleaning member 13, the sheet comes in contact with a web-belt 136 so that excess ink at the leading edge surface is adsorbed, and the sheet slides on a the guide roller 133 with a spur 14 to be conveyed and ejected onto a sheet ejection tray 15. The ejected sheet slides down due to the slant, and the trailing edge surface of the sheet hits the cleaning member 13 and stops there, by which excess ink at the trailing edge surface is adsorbed.

In such a manner, ink at peripheral edge surfaces of a sheet is adsorbed, which prevents contamination of edge surfaces of the sheet and accompanying contamination of the hands of a user and the like.

Next, a second embodiment will be described.

Figure 5:
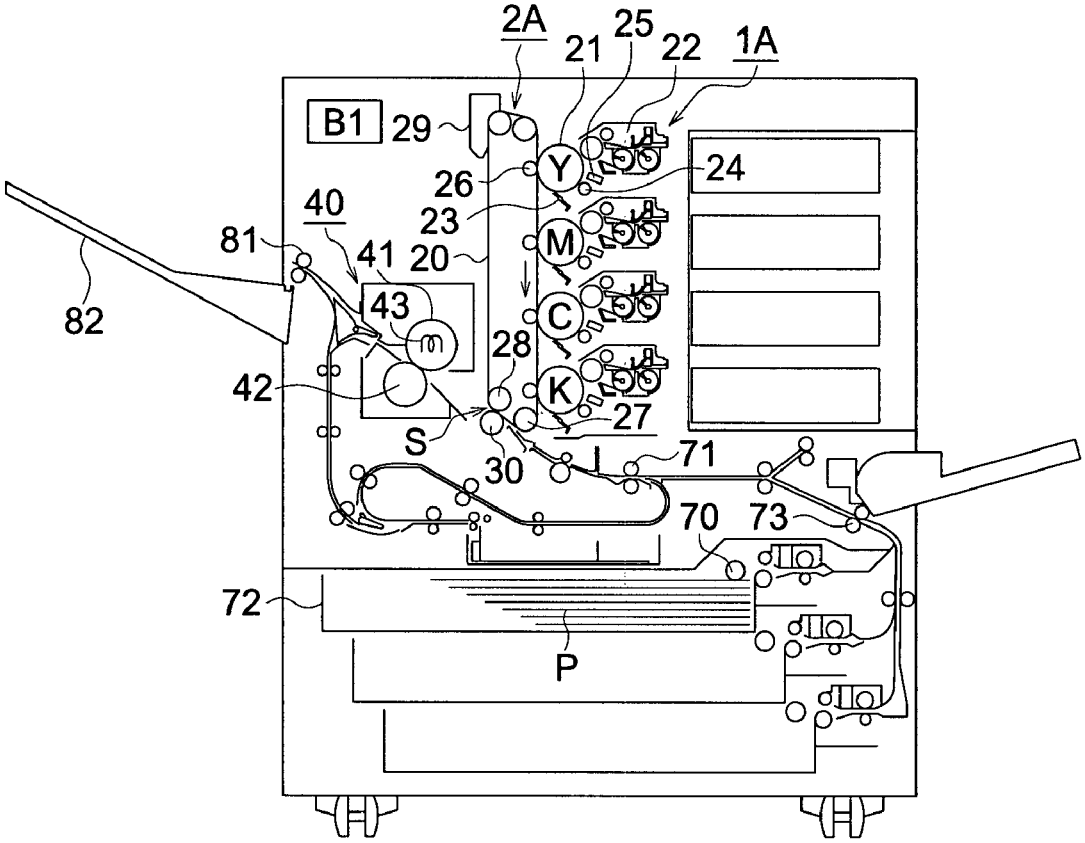
FIG. 5 is a schematic diagram of a full-color electro-photographic apparatus in a second embodiment.

FIG. 5 is a schematic diagram of a full-color electro-photographic apparatus in a second embodiment.

Figure 6:
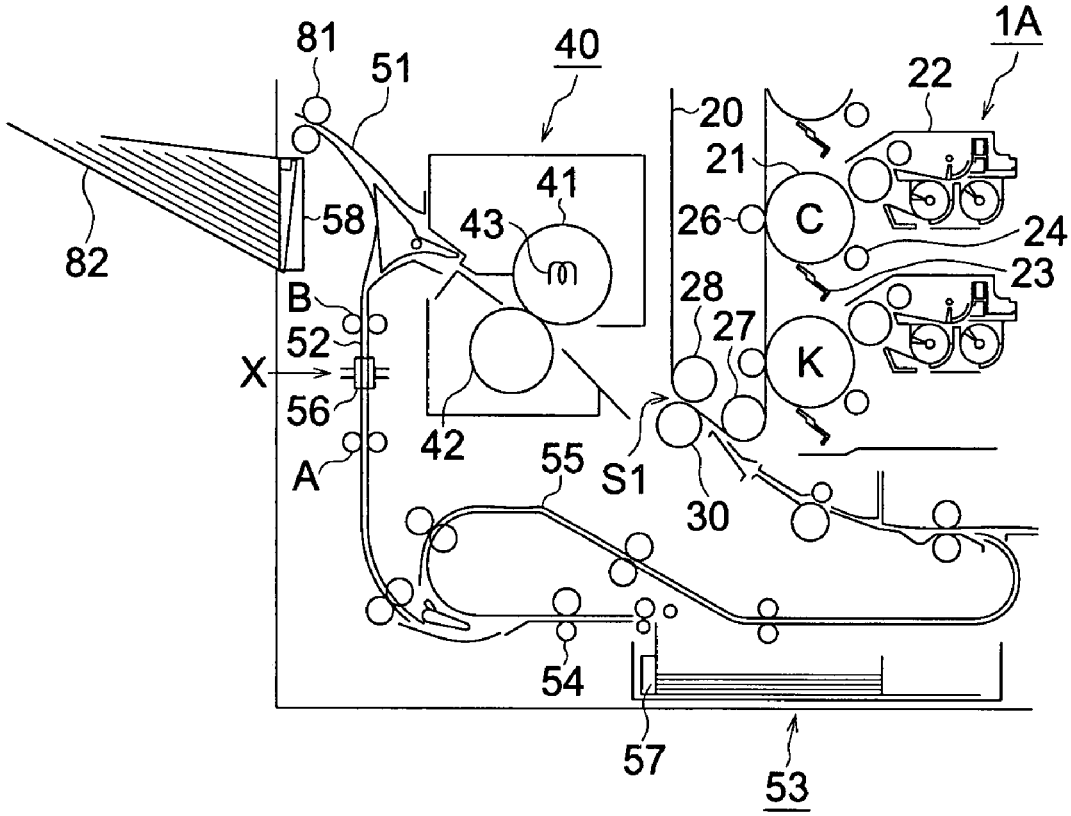
FIG. 6 shows a sheet conveying path in FIG. 5.

FIG. 6 shows a sheet conveying path in FIG. 5.

An image forming unit 1A is constructed with a photoreceptor drum 21, charger 24, developer 22, cleaning unit 23 and the like. Writing device 25 is a digital type exposure writing unit. An intermediate transfer belt 20 is an intermediate transferor. Image forming units 1A for respective colors are disposed in the order of Y, M, C, and K with respect to the running direction of the intermediate transfer belt 20. At the time of transfer, each primary transfer roller 26 presses the intermediate transfer belt 20 against the photoreceptor 21 to make them press-contact with each other. In the press-contact area, each photoreceptor drum 21 rotates at the same linear speed and in the same direction as the intermediate belt 20.

The mechanical structures of the image forming units 1A for the respective colors are the same, and accordingly reference numerals are shown only for the structure for Y color in FIG. 1, and description of the reference numerals representing the elements of structures for the other three colors are omitted.

The intermediate transfer belt 20 is tension-supported by a drive roller 27, earth roller 28, tension roller, driven roller, etc. These rollers, the intermediate transfer belt 20, primary transfer roller 26, cleaning device 29 and the like construct an intermediate transfer belt unit 2A. The charger 25 statically charges photoreceptor drum 21, and electrical signals corresponding to image data are converted into optical signals by an image forming laser so that a writing device 25 projects light onto the photoreceptor 21 to form a latent image. The latent image is visualized (toner image) by the developer 22.

The intermediate transfer roller 2*o* runs with rotation of the drive roller 27 driven by a drive motor, not shown.

The primary transfer roller 26 is applied with a DC voltage in the polarity opposite to the toner, and presses the intermediate transfer belt 20 against the photoreceptor drum 21 from the inner side edge of the belt with a pressing-and-releasing mechanism, not shown, thereby primarily transferring the toner image onto the intermediate transfer belt 29.

The image forming process starts with color Y, such that a toner image is transferred onto the intermediate transfer belt 20. In synchronization with this, superimposed toner images are formed on the intermediate transfer belt 20 in the order of M, C and K in the same image forming process. The intermediate transfer belt 20 carrying the superimposed toner images is transported clockwise, as shown with the arrow. A sheet P is fed out from a sheet cassette 72 by a sheet feed-out roller 70, conveyed through a conveying roller 73 to a timing roller 71 and temporarily stopped there, then synchronized, driven by the timing roller 71, with the superimposed toner images on the intermediate transfer roller 20, conveyed to a nip section S (secondary transfer section) of a secondary transfer roller 30 (in a state pressed against the intermediate transfer belt 20) which is applied with a DC voltage in the polarity opposite to the toner, and the superimposed toner images on the intermediate transfer belt 20 are transferred onto the sheet P at a time.

A fixing device 40 is provided with a heat roller 41 and a press roller 42. The heat roller 41 is formed in a thin tube shape of aluminum provided with a halogen heater 43 that heats the heat roller 41 up to a predetermined temperature from inside, wherein the temperature is detected by a contact-temperature sensor, not shown, arranged for the heat roller 41 and controlled.

A sheet ejection roller 81 ejects a transfer medium having been subjected to fixing, to a sheet ejection tray 82 having a certain inclination angle.

A control section B1 which serves as a control unit performs image forming process control, fixing temperature control, transfer medium conveying control, cleaning member driving control, toner density control and the like.

The structure related to the image forming process has been described. Now, a conveying path of a sheet will be described, referring to FIG. 6.

For normal (with a margin) printing, a sheet P with a toner image transferred at the nip section S1, passes the fixing device 40, conveyed through the conveying path 51 and then ejected onto the sheet ejection tray 82. For double side edged printing, a sheet P is subjected to fixing, then passes a conveying path 52, gets reversed by a reverse feed roller 54 without being stacked on the stack 53, passes a sheet feeding path 55, and a superimposed toner image, which has been formed on the intermediate transfer belt 20, is transferred onto the back side edge surface of the sheet P by the image forming process same as described above. Them the sheet P is subjected to fixing by the fixing device 40, passes the conveying path 51, and is ejected onto the ejection tray 82.

Now, cleaning of edge surfaces of a sheet will be described for a case of printing on an entire sheet.

In a case of printing on an entire sheet, the sheet is subjected to transferring of toner images onto the entire sheet at the nip section S1, passes the fixing device 40, and conveyed to the conveying path 52 side edge. The both side edge surfaces are cleaned by cleaning members 56 at a midway of the conveying path 52, and stacked on the stacker 53 to be temporarily stopped. A cleaning member 57 is arranged in the stacker 53 to clean the surface of the trailing edge portion (with respect to the conveying direction) of the stopping sheet. After completion of cleaning, the sheet is re-fed from the stacker 53 to return to the conveying path 52 side, passes through the conveying path 51, and is ejected by the sheet ejection roller 81 onto the sheet ejection tray 82. At the position where the sheet is ejected, the rest of the edge surfaces of the sheet (Herein, the edge which was the trailing edge before re-feeding becomes the leading edge after re-feeding.) is cleaned.

The structures of the cleaning members 56 to 58 will be described below.

Figure 7:
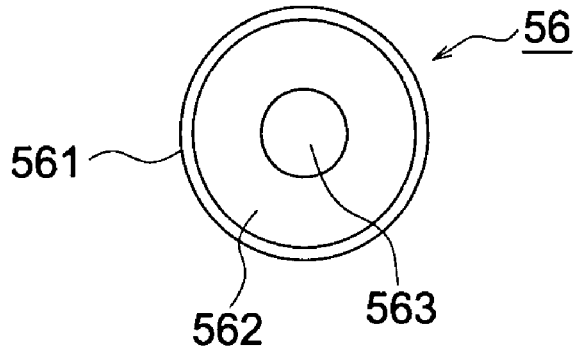
FIGS. 7*a* to 7*b* are diagrams showing three types of cleaning members in FIG. 5.
Figure 7:
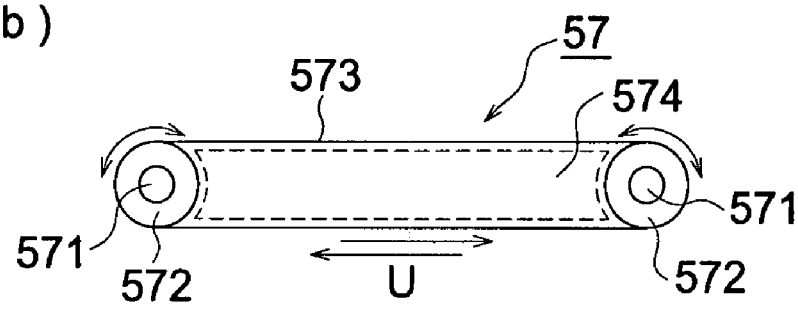
Figure 7:
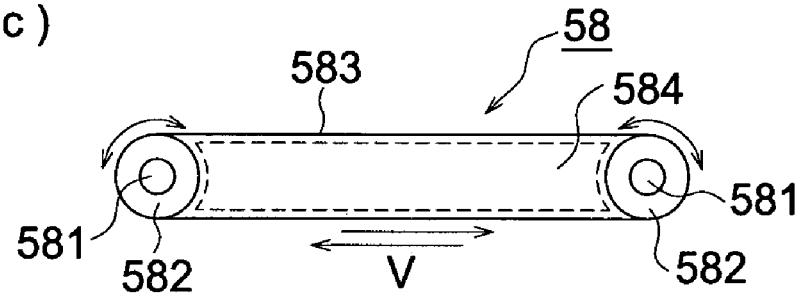

FIGS. 7*a* to 7*c* show three types of cleaning members, shown in FIG. 6.

FIGS. 8*a* to 8*d* are plan views of structures where the three types of cleaning members are respectively arranged.

FIG. 7*a* shows the cross-sectional view of a cleaning member 56, which is constructed with a sponge roller 562, core metal 563 being the rotation shaft of the sponge roller 562, nonwoven fabric 561 wound around the outer circumference of the sponge roller 562, and the like.

Figure 8:
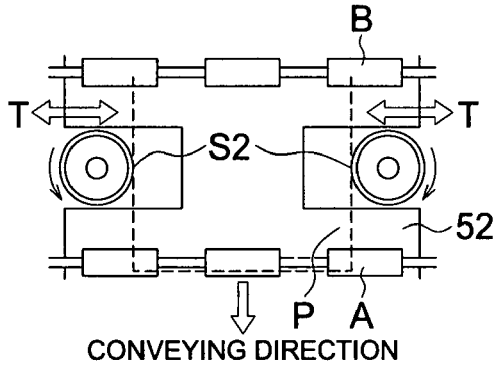
FIGS. 8*a* to 8*d* are plane views of places where the three types of cleaning members are respectively disposed.
Figure 8:
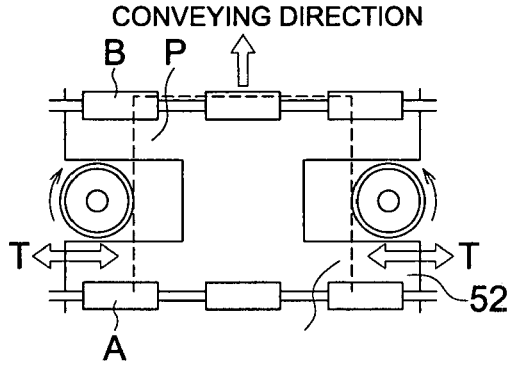
Figure 8:
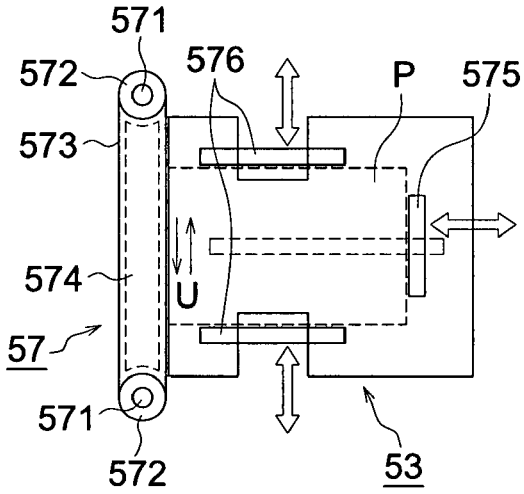
Figure 8:
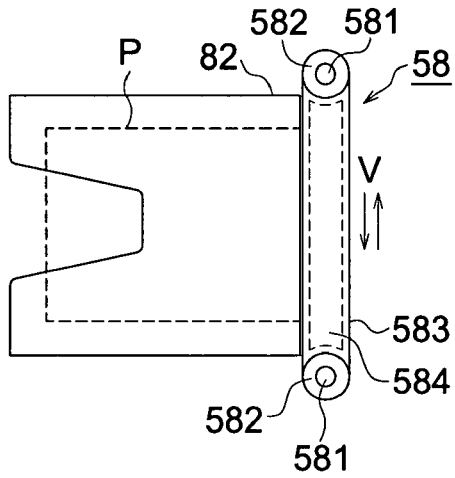

In FIGS. 8*a* and 8*b*, the cleaning members 56 are mounted between the conveying rollers A and B on slide members (on both sides along the sheet conveying direction), not shown, which can respectively slide in arrow direction T, and the sponge rollers 562, which change in the distance therebetween corresponding to the width size of a sheet, are position-controlled by a control unit so that the both side edge surfaces of the sheet can contact the sponge rollers 562. The metal cores 563 are driven by a driving section, not shown, and thus the sponge rollers 562 rotate at the contact sections S2, where the sponge rollers 562 contact the side edge surfaces of the sheet, in the direction opposite to the sheet conveying direction. FIGS. 8*a* and 8*b* are plan views from arrow direction X in FIG. 6.

In FIG. 8*a*, the cleaning members 56 retreat at a position where the cleaning members 56 do not cause a load on sheet conveyance until a sheet having been subjected to printing on its both sides and passed the conveying path 52 is nipped at the leading edge by the conveying rollers A. When the leading edge of the sheet gets nipped, the cleaning members 56 contact the side edge surfaces of the sheet, and rotate in the direction opposite to the sheet conveying direction so as to clean off toner at the both side edge surfaces.

FIG. 7*b* shows a cross-sectional view of the cleaning member 57, and FIG. 8*c* shows a cross-sectional view, viewed from above, of the stacker 53 having the cleaning member 57 thereon. The cleaning member 57 is structured such that a nonwoven fabric 573 in a belt shape is tension-supported by a pair of rollers constructed with a core metal 571 and an elastic body 572. Either roller is driven by a driving source to rotate in the arrow direction, and thus the nonwoven fabric 573 reciprocally moves at a predetermined frequency in arrow direction U (perpendicular to the thickness of the sheet). A backup member 574 is arranged inside the nonwoven fabric 573, and the edge surface of the sheet hits the outer surface of the nonwoven fabric 573 and stops there. The reciprocal motion of the belt cleans off ink at the trailing edge surface of the sheet P which is stopping on the stacker. The trailing edge of cleaned sheet P becomes the leading edge, and the sheet is re-fed. Herein, the stacker 53 is provided with a leading edge (namely, trailing edge in re-feeding) restricting plate 575 and side surface restricting plates 576 which slide along guides, to align stacked sheets P and push the trailing edge surface (namely, leading edge surface in re-feeding) of a sheet having been conveyed there, against the cleaning member 57.

FIG. 7*c* shows a cross-sectional view of the cleaning member 58, and FIG. 8*d* shows a cross-sectional view, viewed from above, of the sheet ejection tray 82 having the cleaning member 58 thereon. The cleaning member 58 is structured such that a nonwoven fabric 583 in a belt shape is tension-supported by a pair of rollers constructed with a core metal 581 and an elastic body 582. Either roller is driven by a driving source to rotate in the arrow direction, and thus the nonwoven fabric 583 reciprocally moves in arrow direction V (perpendicular to the thickness of the sheet). A backup member 584 is arranged inside the nonwoven fabric 583, and the edge surface of the sheet hits the outer surface of the nonwoven fabric 583 and stops there. The reciprocal motion of the belt cleans off ink at the trailing edge surface of the sheet P having been ejected.

The three types of cleaning members have been described. However, for an image recorded on a single side of a sheet P which sticks out on the trailing edge side, the sheet P having been conveyed through the conveying path 51 without being conveyed to the stacker 53, and ejected onto the sheet ejection tray 82 may be cleaned only by the cleaning member 58.

In accordance with invention, contamination of edge surfaces of a recording medium can be removed, and particularly, a problem of contaminating the hands of a user in taking out sheets stacked on a tray and a problem of contaminating other print sheets can be solved.

What is claimed is:

1. An image forming apparatus, comprising:

an image forming section being able to form an image with a recording material on an image forming surface of a recording medium to an edge thereof; and a cleaning section structured to clean off the recording material adhering to an edge surface of the recording medium after the image forming section forms the image on the image forming surface, wherein the edge surface is adjacent to the image forming surface.

2. The image forming apparatus of claim 1, wherein toner is employed as the recording material; and wherein the image forming section transfers a toner image onto the recording medium and then fixes the toner image thereon with heat.

3. The image forming apparatus of claim 1, wherein ink is employed as the recording material; and wherein the image forming section forms an image on the image forming surface of recording medium to the edge thereof with a recording head.

4. The image forming apparatus of clam 1, wherein the edge surface is rubbed by a cleaning member, thereby the recording material adhering to the edge surface is cleaned by the cleaning member.

5. The image forming apparatus of claim 1, wherein the cleaning section further cleans the leading and/or trailing edge surface of the recording medium, with respect to the conveying direction, in a state that conveying of the recording medium is stopped by a stop section.

6. The image forming apparatus of claim 5, wherein the stop section is formed as a stacker of recording mediums.

7. The image forming apparatus of claim 1, wherein the cleaning section cleans both side edge surfaces of the recording medium, with respect to a conveying direction, in a conveying process of the recording medium.

8. The image forming apparatus of claim 7, wherein the both side edge surfaces of the recording medium is cleaned by cleaning members in a roller form in a state where a leading edge of the recording medium is nipped by conveying rollers; and wherein the cleaning members rotate in a direction opposite to the conveying direction at the both side edge surfaces of the recording medium.

9. The image forming apparatus of claim 7, wherein the cleaning section further cleans the leading and/or trailing edge surface of the recording medium, with respect to the conveying direction, in a state that conveying of the recording medium is stopped by a stop section.

10. The image forming apparatus of claim 9, wherein the side edge surfaces of the recording medium are cleaned by cleaning members in a roller form; and wherein the leading and/or trailing edge surface of the recording medium is cleaned by a cleaning member formed of a web-belt.

* * * * *